US005848836A

United States Patent [19]

Graber et al.

[11] Patent Number: 5,848,836

[45] Date of Patent: Dec. 15, 1998

[54] TUBE LIGHT WITH FLUORESCENT LAMPS

[75] Inventors: Warren S. Graber, Inverness; Horacio A. Baggio, Niles, both of Ill.

[73] Assignee: Woodhead Industries, Inc., Deerfield, Ill.

[21] Appl. No.: 810,261

[22] Filed: Mar. 3, 1997

Related U.S. Application Data

[60] Provisional application No. 60/012,785 Mar. 4, 1996.

[51] Int. Cl.[6] ..... F21S 3/00

[52] U.S. Cl. ..... 362/223; 362/225; 362/267; 362/376

[58] Field of Search ..... 362/217, 222, 362/223, 225, 260, 267, 376

[56] References Cited

U.S. PATENT DOCUMENTS

| | | | |
|---|---|---|---|
| 2,355,467 | 8/1944 | Proulx | 362/225 |
| 2,511,440 | 6/1950 | Long | 362/222 |
| 2,874,270 | 2/1959 | Douglass et al. | 362/222 |
| 3,141,620 | 7/1964 | Guggemos | 362/225 |
| 3,805,053 | 4/1974 | Julinot | 362/223 |
| 4,092,706 | 5/1978 | Vest | 362/390 |
| 4,663,697 | 5/1987 | Stearns et al. | 362/225 |
| 4,800,473 | 1/1989 | Tremblay | 362/217 |
| 4,947,475 | 8/1990 | Bright | 362/34 |
| 5,088,015 | 2/1992 | Baggio et al. | 362/217 |
| 5,257,172 | 10/1993 | Erickson | 362/226 |
| 5,493,482 | 2/1996 | Bowen | 362/260 |

FOREIGN PATENT DOCUMENTS

| | | |
|---|---|---|
| 1538568 | 7/1968 | France . |
| 311065 | 6/1929 | United Kingdom . |

*Primary Examiner*—Alan Cariaso
*Attorney, Agent, or Firm*—Emrich & Dithmar

[57] ABSTRACT

A fluorescent tube lighting fixture includes a tubular main frame member which also acts as a conduit for routing wires between the ballast and the lamp holders. A frame extension the form of a Tee is threaded onto one end of the main frame member; and another portion of the Tee receives an adapter which secures the end cap to the fixture. Wire is routed through the adapter, and through the Tee into the main tubular frame member, all of which portions cooperate to act as a protective conduit for the power cord, with a single opening in the end cap. By removing a single compression nut, the end cap and lamp guard can be moved to gain access to the interior of the lamp for maintenance.

5 Claims, 2 Drawing Sheets

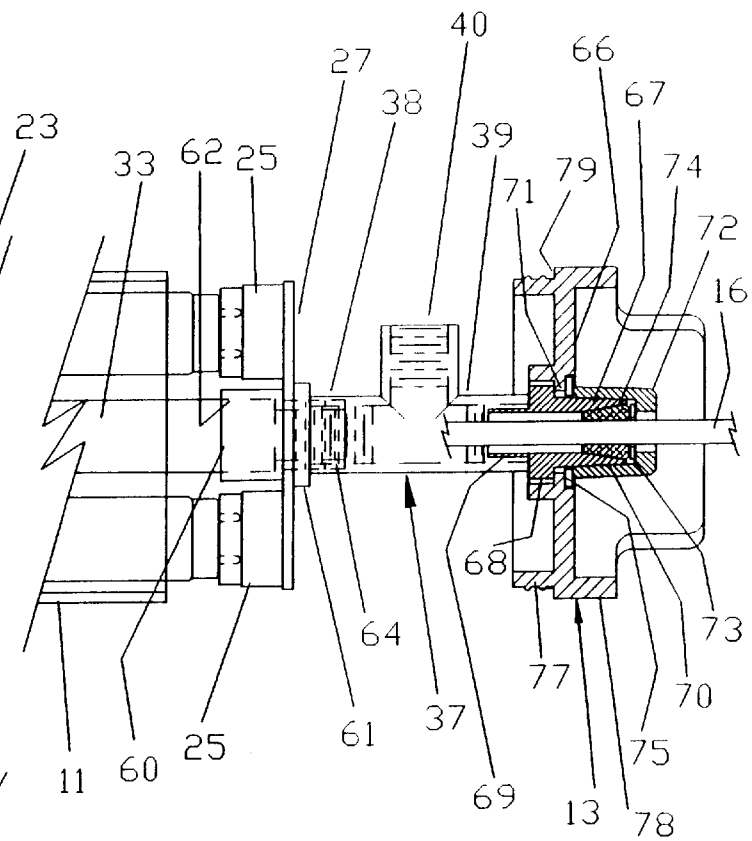
FIG. 4
FIG. 3
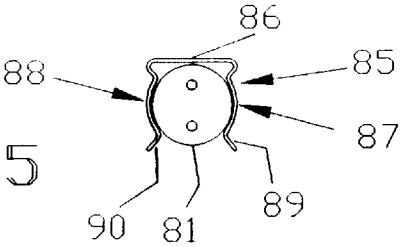
FIG. 5

TUBE LIGHT WITH FLUORESCENT LAMPS

RELATED APPLICATION

This application claims the benefit of copending U.S. Provisional Application Ser. No. 60/012,785 filed Mar. 4, 1996 for TUBE LIGHT WITH FLUORESCENT LAMPS.

FIELD OF THE INVENTION

The present invention relates to tube lights, and particularly tube lights employing fluorescent lamps. Tube lights of the kind with which the present invention is concerned are used in manufacturing plants, in the chemical industries, and in the aerospace manufacturing industries for providing portable lighting for workers which is flexible, yet which affords adequate light for the work to be done.

BACKGROUND OF THE INVENTION

Tube lights capable of being connected end-to-end and capable of readily being adjusted in location are known. In the past, the construction of tube lights or fixtures has included a main metal frame on which the fluorescent lamps, ballast, and other components are mounted, including a cylindrical, clear plastic lens or tube guard for transmitting light from the fluorescent lamps while protecting the lamps from the environment and from otherwise being damaged.

In this type of structure, at the end of the frame, which extends longitudinally of the fixture, there are first and second end caps, typically made of rubber or other high quality flexible material for cushioning the ends of the lamps against damage and permitting the power cords to be routed into one end of the fixture and out of the other end of the fixture so that adjacent fixtures can be strung in a line or otherwise grouped in an indefinite number.

In these prior fixtures, the frame was provided with metallic end plates which assisted in mounting the tube guard, and the end caps were mounted to the end plates of the frame. This structure not only added an expense to the fixtures, but also made it cumbersome and time-consuming to disassemble the light fixture for replacing the fluorescent lamps or the ballast or other maintenance procedures. These fixtures are expensive, intended primarily for industrial use, and it is therefore important that they be maintained, and it would be advantageous if disassembly of the fixture were quick and convenient and did not require special tools.

SUMMARY OF THE INVENTION

The present invention contemplates a long tubular element forming the main frame member adjacent the lamps. The tubular member not only acts as the frame member, but it also acts as a conduit for routing wires between the ballast and the lamp holders. Adjacent one end of the tubular frame member there is a threaded Tee. The Tee includes two aligned cross portions and a perpendicular base portion, all of which are internally threaded. One of the aligned cross portions of the Tee is threaded onto one end of the tubular frame member, and the other cross portion of the Tee receives an adapter which secures the end cap to the fixture. Wire is routed through the adapter, and through the cross portions of the Tee into the main tubular frame member, all of which portions cooperate to act as a protective conduit for the power lines. The end cap is then secured, and the power cord routed through it is fastened in a moisture-sealed manner, by means of a conventional rubber grommet and compression nut.

By removing the compression nut (which normally can be accomplished by hand or with any readily available tools), the end cap can be removed and access gained to the interior of the lamp very readily, by sliding the tube guard off the end cap at the other end and over the internal components and lamps for access.

Other features and advantages of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWING

FIG. 3 is an enlarged view of the left end cap of FIG. 2;

FIG. 4 is an enlarged view of the right end cap of FIG. 2; and

FIG. 5 is an end view of a metal clip used to secure the lamps.

DETAILED DESCRIPTION OF THE ILLUSTRATED EMBODIMENT

Figure 1:
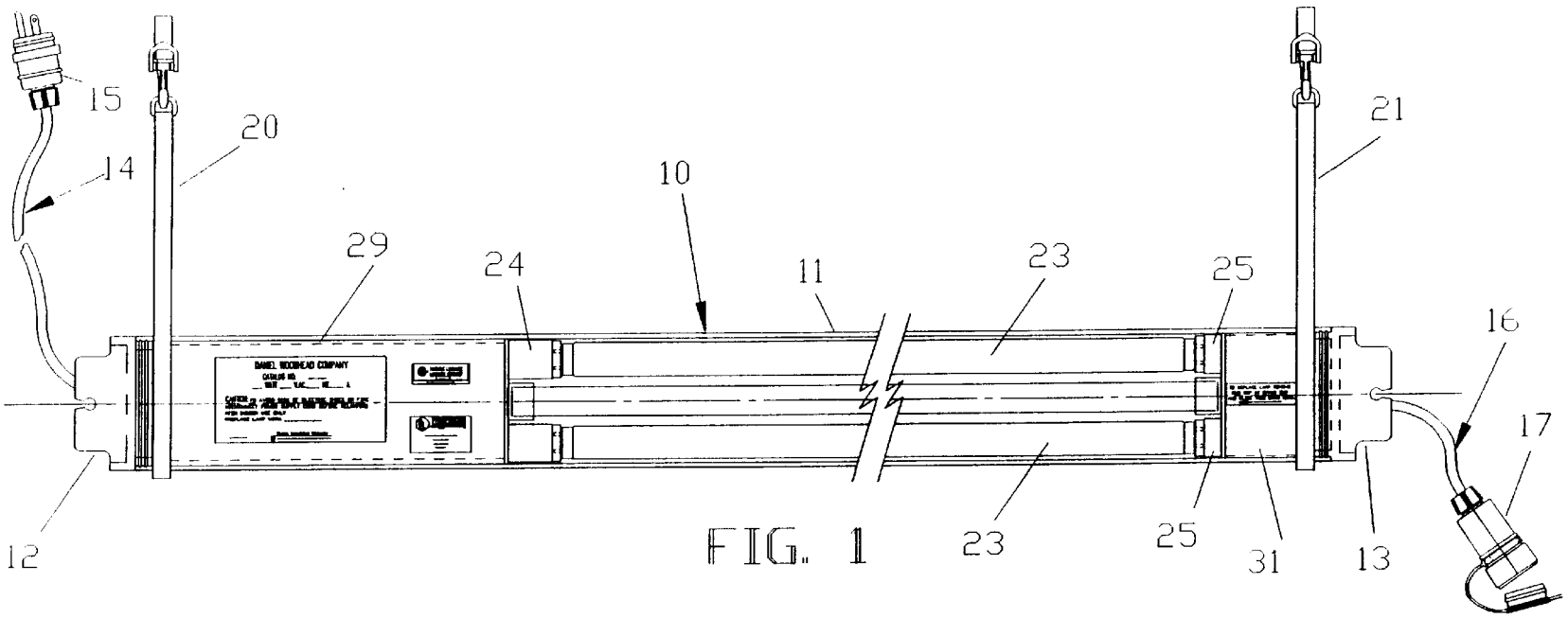
FIG. 1 is a side view of a tube light constructed according to the present invention with the center portions of the fixture and the feed-in power cord broken away for fore-shortening.

Referring first to FIG. 1, reference numeral 10 generally designates a tube light using fluorescent lamps, the centers of the fixture and the lamps being cut away to fore-shorten the drawing for clarity.

The tube light 10 includes an outer wall or lamp guard 11 (sometimes called a "tube guard") in the form of a cylindrical, clear plastic tube. First and second end caps, 12, 13 are assembled at the left and right ends of the tube guard respectively. A first power cord generally designated 14, and including a male connector or plug 15, is routed through the left end cap 12. A similar power cord generally designated 16, but having a female connector or receptacle 17 is routed through the right end cap 13.

In this manner, the plug 15 can be connected to a conventional power source (or to the female receptacle of a like tube light) and, in addition to providing electrical power for the tube light 10, it also couples power to the receptacle 17 so that a similar tube light or other electrical appliance may draw power from the connector 17. Thus, for example, similar tube lights can be strung in a line or grouped in any manner desired to light an area.

The tube light 10 may be suspended from overhead supports by left and right straps 20, 21, each of which includes, in the illustrated embodiment, a buckle or clamp which permits adjusting the length of the strap. The straps may be secured to the fixture, as is known in the art, by conventional hook-and-loop fasteners such as those sold under the trademark VELCRO, one of the fastener members being secured directly to the outer surface of the lamp guard 11 at each end thereof so as to avoid interference with the transmission of light.

Inside the lamp guard 11, there are mounted a plurality of fluorescent lamps 23, each of which is provided with a left lamp holder 24 and a right side lamp holder 25. Behind the two fluorescent lamps 23 as seen in FIG. 1, there are two additional, aligned fluorescent lamps with associated lamp holders, making a total of four lamps. But the construction can be adapted to any reasonable number of lamps depending on the application.

Figure 2:
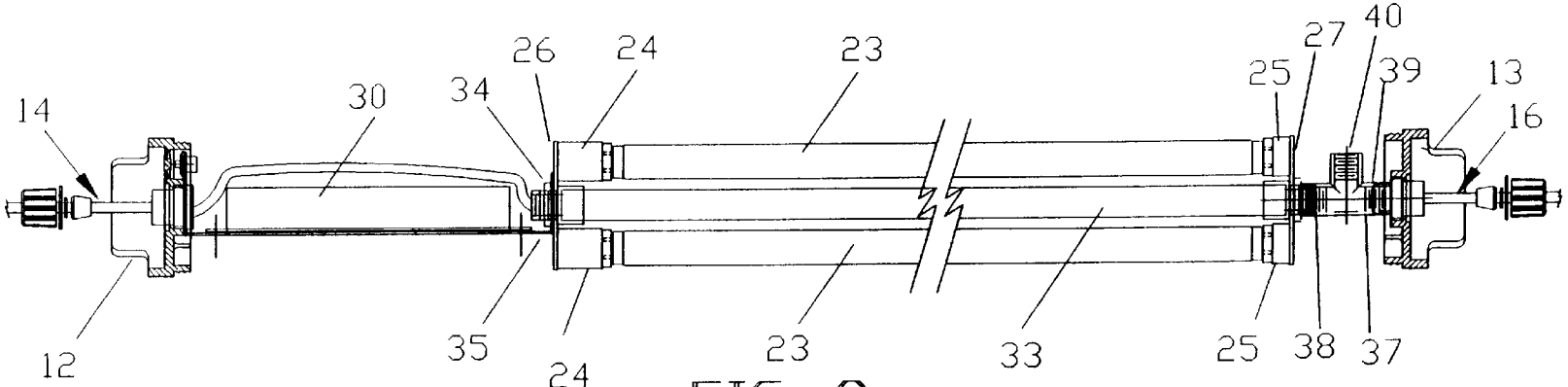
FIG. 2 is a view similar to FIG. 1, but with the tube guard and cover plates removed, the lock nut assemblies in exploded relation relative to their associated end caps, and with the end caps in cross-section for clarity.

As best seen in FIG. 2, the lamp holders 24 are mounted to a first lamp mounting plate 26, and the right-side lamp holders 25 are mounted to a second lamp mounting plate 27. The two fluorescent lamps not seen are similarly mounted to lamp holders secured on plates 26, 27.

Returning to FIG. 1, a first cover plate 29 is provided within the lamp guard 11 for covering a ballast seen better in FIG. 2 and designated 30. A similar cover plate 31 is located to the right of the plate 27, for covering the components within the lamp guard 11 between the mounting plate 27 and the right end cap 13, as will be clear from subsequent description.

Turning now particularly to FIG. 2, elongated tubular frame member 33 is located at the center of the four fluorescent lamps 23; and it is provided with threaded ends received in corresponding aligned apertures in the lamp mounting plates 26, 27. As best seen in FIG. 3, the left end of the tubular frame member 23 is secured to the mounting plate 26 by means of an internally threaded adapter 34 received on the tubular frame member 33. Between the shoulder of the adapter 34 and the end plate 26, there is mounted the upright flange 36 of a mounting bracket 35 on which the ballast 30 is mounted.

A Tee-shaped tubular conduit generally designated 37 has two aligned cross portions 38, 39 and a base portion 40, all of which are internally threaded. The left cross portion 38 is received on the right-side of the tubular member 33, by components which will be described, and which secure the mounting plate 27. The aligned cross portions 38, 39 comprise a tubular extension of the main frame 33 so that wires can be routed through the fixture. Base portion 40 of the Tee provides an access port to the wires in the frame/conduit for wiring the right-side lamp holders to the power wires. Thus, the base portion could be a simple access opening rather than a leg, as shown.

The end cap 12 is mounted to the left side of the bracket or mounting plate 35, as seen in FIG. 3, and the right end cap 13 is mounted to the second or distal cross portion 39 of the Tee 37, as seen in FIG. 4.

Turning now to FIG. 3, the left side of the bracket 35 carrying ballast 30 is provided with an upwardly turned flange 43 which has an aperture aligned with a corresponding aperture in a transverse wall 44 of the left end cap 12. An adapter 45 having external threads 47 is received through these aligned apertures, and secured by an apertured nut 46 securing the flange 43 to the adapter by means of a washer. A spacer 42 is located between the inside surface of transverse wall 44 and the flange 43. The adapter 46 is of tubular form with a center conduit through which the cord 14 is received for connection to the components of the light fixture (i.e., the ballast).

A switch 48 is mounted to the upper portion of the flange 43 of the bracket 35, and a pad 49 is aligned with the plunger of the switch 48 for actuating the switch. The pad 49 is defined in the transverse wall 44 of the end cap 12, and is formed as the center member of a thinned wall portion 50, formed in the transverse wall 44. As is known, the end cap 12 includes a proximal skirt portion 52 which is received in and engages the left side of the lamp guard 11, and an outer skirt portion 53, a portion of which designated 54 is extended outwardly for cushioning and protection.

A tapered rubber grommet 56 is slid over the cord 14 and received in the interior conduit of the adapter 45 for securing the cord to the grommet. A first washer 57 is located on the cord 14 on the left side of the tapered grommet 56, and a compression nut 58 and larger washer 59 is also received on the cord for threading engagement with the threaded portion 47 of the adapter 45, and for securing the cord 14 to the adapter, forming a moisture resistant seal. The right side end cap assembly is similar to the left one, and will be described in more detail below.

Turning now to FIG. 4, the left transverse portion 38 of the Tee conduit 37 is provided with interior threads, as previously indicated. A coupling adapter 60 having a collar 61 and an internally-threaded portion 62 of reduced diameter is received in a n aperture in the mounting plate 27. The portion 62 of the adapter 60 is received on the externally-threaded right side of the tubular frame member 33. A threaded coupler 64 is received in the right side of the adapter 60 as well as engaging the interior threads of the cross portion 38 of the Tee, thereby securing the Tee 37 to the longitudinal tubular frame 33 as well as to the mounting plate 27.

Turning now to the right side of FIG. 4, the rubber end cap 13 includes a transverse wall 66 provided with a central aperture 71 aligned with the center opening of the cross portion 39 of the Tee 37. An adapter 67 extends through the center opening 71 in the transverse wall 66. Adapter 67 has a threaded extension 69 which is received in the portion 39 of the Tee 37. The adapter 67 also includes a flange 68 for engaging the inner surface of wall 66 surrounding the opening 71. Adapter 67 also includes an externally threaded extension 70 received in opening 71. A first washer 75 is located between the adapter 67 and the right or outer side of the transverse wall 66 surrounding the aperture 71.

The output power cord 16 is fed through a compression nut 72, second washer 73 and rubber sealing grommet 74, with the compression nut 72 being assembled to the threaded portion 70 of the adapter 67. Washers 73 and 75 are of low friction material (referred to as friction release) to permit the compression nut 72 to be removed by hand (or if needed, assistance with a pliers or the like).

End cap 13 is similar to end cap 12 in that it includes an inner skirt portion 77, which is received inside the lamp guard 11 and couples to the lamp guard, and an outer skirt 78. A shoulder 79 between the skirts 77, 78 engages the end of the lamp guard when the end cap is assembled.

Gaining access to the interior of the fixture, for example to replace a lamp, is a simple matter which can be accomplished without special tools, and in most cases, without any tools. First, the compression nut 72 (i.e., the one coupled to the side of the fixture adjacent the tee fitting 37 and opposite the ballast) is removed. Next, the washers 73 and 75, and grommet 74 are slid over the cord 16. End cap 13 is then removed from the lamp guard 11 by working loose the inner skirt 77 of the flexible, rubber end cap from the inside of the lamp guard. This frees the end cap and it is slid over the cord 16.

Next, the other end (i.e., left end in FIG. 3) of the lamp guard is worked loose from the other end cap 12 in a similar manner. The left lock nut 58, however, does not have to be removed. All of the loosened components on the right side, including the lamp guard, may then be slid completely off the ballast, and over lamps and Tee conduit fitting 37, to gain access to whichever part of the interior of the fixture requires maintenance.

Still referring to FIG. 3, the lamp holder 24 is of a commercially available type including a fixed base 80 which is mounted to the end plate 26; and a telescoping receptacle 81 which is movable between the extended use position shown in the drawing, and a retracted, installation position in which the receptacle 81 moves inwardly into the base 80 in telescoping relation. This permits the connector pins on the right side of the lamp 23 to be removed from their associated lamp holder 25, to facilitate installation or removal of the lamps. In use, however, it has been found that a severe jolt may unseat the lamp 23, particularly in rugged use conditions of the kind sometimes found in applications for which the present invention is intended.

To forestall such a situation, a clip 85 is placed over the receptacle 81, and inhibits movement of the receptacle to the retracted position, thereby locking the lamp in place until the clip 85 is removed.

Turning now to FIG. 5, the clip 85 is preferably made of spring steel, and it includes a generally flat base portion 86, and first and second opposing side portions, each side portion including a curved segment designated 87, 88 respectively, and conforming to the shape of the receptacle. The distal ends of the curved sides 87, 88 are formed into outwardly curved feet 89, 90, respectively, which provide lead-in surfaces, and, when the spring clip is being applied, the feet 89, 90 force the legs outwardly and the curved portions 87, 88 to straddle the receptacle 81 and grip it.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In a portable fluorescent lighting fixture having a plurality of fluorescent lamps, a tubular lamp guard surrounding the lamps, said lamp guard having first and second open ends, and at least one rubberized end cap coupled to one end of said lamp guard, the improvement comprising:

an elongated tubular frame providing a conduit for wire, said frame having one end extending adjacent said one end cap;

said end cap including a transverse wall and characterized as defining a single, central aperture, said aperture aligned with said tubular frame when said end cap is assembled to said lamp guard; and removable mounting means for mounting said transverse wall of said end cap to said one end of said tubular frame and for permitting an electrical cord to pass through said aperture of said end cap and directly into said one end of said tubular frame;

said removable mounting means comprises an adapter received over said power cord and having a first threaded end coupled to the outboard end of said tubular frame adjacent said one end cap and including a peripheral flange for engaging the inner surface of said transverse wall of said end cap adjacent said opening therein, said adapter including a second threaded end extending through said transverse wall;

a first friction release washer engaging the outer side of said transverse wall adjacent said aperture therein;

a compressible sealing member received on said power cord and received in said second end of said adapter; a second friction release washer engaging the outboard end of said sealing member; and a compression nut received on said cord and threadedly engaging said second threaded end of said adapter and engaging said first and second friction release washers; whereby when said compression nut is unthreaded from said adapted, said end cap may be removed to gain access to the interior of said fixture.

2. In a portable fluorescent lighting fixture having a plurality of fluorescent lamps, a tubular lamp guard surrounding the lamps, said lamp guard having first and second open ends, and at least one rubberized end cap coupled to one end of said lamp guard, the improvement comprising: an elongated tubular frame providing a conduit for wire, said frame having one end extending adjacent said one end cap; said end cap including a transverse wall and characterized as defining a single, central aperture, said aperture aligned with said tubular frame when said end cap is assembled to said lamp guard; and removable mounting means for mounting said transverse wall of said end cap to said one end of said tubular frame and for permitting an electrical cord to pass through said aperture of said end cap and directly into said one end of said tubular frame; wherein said tubular frame comprises an elongated main frame conduit extending adjacent said lamps; a conduit extension having a proximal end connected to one end of said mainframe and forming a continuation of the conduit of said tubular main frame to a location adjacent said one end cap; said apparatus further comprising first and second mounting plates mounted to respective ends of said main frame for mounting said lamps to said frame; and means for mounting said one end cap to the distal end of said conduit extension.

3. The apparatus of claim 2 further comprising first and second pluralities of lamp holders, one plurality for each end of each of said lamps, said first plurality of lamp holders being mounted to said first mounting plate, and said second plurality of said lamp holders being mounted to said second mounting plate.

4. In a portable fluorescent lighting fixture having a plurality of fluorescent lamps, a tubular lamp guard surrounding the lamps, said lamp guard having first and second open ends, and at least one rubberized end cap coupled to one end of said lamp guard, the improvement comprising: an elongated tubular frame providing a conduit for wire, said frame having one end extending adjacent said one end cap; said end cap including a transverse wall and characterized as defining a single, central aperture, said aperture aligned with said tubular frame when said end cap is assembled to said lamp guard; and removable mounting means for mounting said transverse wall of said end cap to said one end of said tubular frame and for permitting an electrical cord to pass through said aperture of said end cap and directly into said one end of said tubular frame; wherein said removable mounting means includes an adapter coupled to the end of said tubular frame member for securing said transverse wall of said end cap adjacent the central aperture thereof; a flexible seal received in said adapter; and a threaded compression nut for threadedly engaging said adapter exterior of said transverse wall of said end cap to secure said end cap to said frame, said end cap defining a peripheral skirt fitting within the adjacent end of said lamp guard when said end cap is assembled thereto.

5. The apparatus of claim 4 wherein said lighting fixture includes a second rubberized end cap adapted to be mounted to the other end of said lamp guard and defining a single, central aperture; said apparatus further including a power feed cord extending through said central aperture of said second end cap and into the interior of said fixture; and means for mounting said second end cap to said second cord in moisture resistant relation, including a threaded compression nut for securing said second cord to said end cap.

* * * * *